US006368159B1

(12) United States Patent
Hess et al.

(10) Patent No.: US 6,368,159 B1
(45) Date of Patent: Apr. 9, 2002

(54) LIGHT PIPE FOR A MODULAR JACK

(75) Inventors: John Matthew Hess, Sparks, MD (US); Derek Imschweiler, Dallastown, PA (US)

(73) Assignee: Stewart Connector Systems, Inc., Glen Rock, PA (US)

( * ) Notice: Subject to any disclaimer, the term of this patent is extended or adjusted under 35 U.S.C. 154(b) by 0 days.

(21) Appl. No.: 09/735,680

(22) Filed: Dec. 13, 2000

(51) Int. Cl.[7] ..... H01R 23/02
(52) U.S. Cl. ..... 439/676; 385/901
(58) Field of Search ..... 439/676, 490, 439/910, 488; 385/139, 149, 88, 89, 92, 14, 901, 147, 36

(56) References Cited

U.S. PATENT DOCUMENTS

| | | | | | |
|---|---|---|---|---|---|
| 4,978,317 | A | | 12/1990 | Pocrass | 439/490 |
| 5,237,641 | A | * | 8/1993 | Jacobson et al. | 385/146 |
| 5,303,322 | A | * | 4/1994 | Winston et al. | 385/146 |
| 5,537,229 | A | * | 7/1996 | Brandestini et al. | 358/509 |
| 5,548,676 | A | * | 8/1996 | Savage, Jr. | 385/92 |
| 5,612,794 | A | * | 3/1997 | Brandestini et al. | 358/505 |
| 5,613,873 | A | | 3/1997 | Bell, Jr. | 439/490 |
| 5,655,832 | A | * | 8/1997 | Pelka et al. | 362/296 |
| 5,700,084 | A | * | 12/1997 | Yasukawa et al. | 362/275 |
| 5,729,367 | A | * | 3/1998 | Smith | 359/24 |
| 5,741,152 | A | | 4/1998 | Boutros | 439/490 |
| 5,790,041 | A | | 8/1998 | Lee | 340/815.45 |
| 5,805,275 | A | * | 9/1998 | Taylor | 356/3.16 |
| 5,815,278 | A | * | 9/1998 | Johnson et al. | 356/445 |
| 5,876,239 | A | | 3/1999 | Morin et al. | 439/490 |
| 5,884,991 | A | * | 3/1999 | Levis et al. | 353/122 |
| 5,894,539 | A | * | 4/1999 | Epstein | 385/133 |
| 5,915,993 | A | | 6/1999 | Belopolsky et al. | 439/490 |
| 5,986,746 | A | * | 11/1999 | Metz et al. | 356/71 |
| 6,005,722 | A | * | 12/1999 | Butterworth et al. | 359/712 |
| 6,097,549 | A | * | 8/2000 | Jenkins et al. | 359/726 |
| 6,130,730 | A | * | 10/2000 | Jannson et al. | 349/65 |
| 6,160,948 | A | * | 12/2000 | McGaffigan | 385/901 |
| 6,222,623 | B1 | * | 4/2001 | Wetherell | 356/236 |
| 6,222,677 | B1 | * | 4/2001 | Budd et al. | 359/630 |
| 6,224,417 | B1 | * | 5/2001 | Belopolsky et al. | 439/490 |
| 6,226,440 | B1 | * | 5/2001 | Lyons | 385/901 |

* cited by examiner

*Primary Examiner*—Gary Paumen
*Assistant Examiner*—Phuong Nguyen
(74) *Attorney, Agent, or Firm*—Steinberg & Raskin, P.C.

(57) ABSTRACT

The new modular jack is mounted to a PC board to overlie an LED on this board. The jack includes a light pipe having a light-entry zone in its bottom surface, a first light reflection zone in its rear surface, a light indicator zone in its front surface and a longitudinal axis in the rear-to-front direction. The light pipe further includes in its top surface a second light reflection zone situated forward of the first light reflection zone, the first and second light reflection zones positioned to receive light from the LED and to reflect same forward to the light indicator zone which is visible at the front of the jack.

26 Claims, 19 Drawing Sheets

FIG.9A
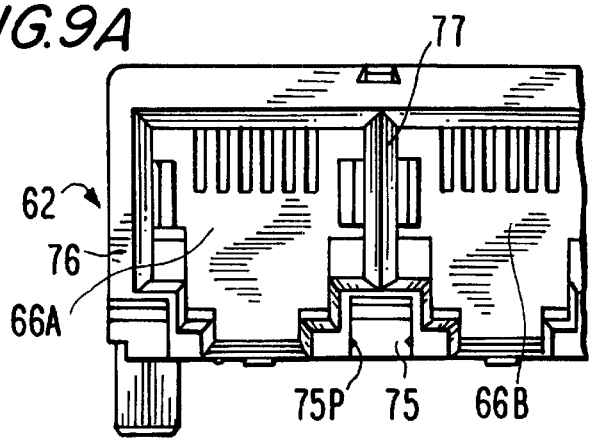
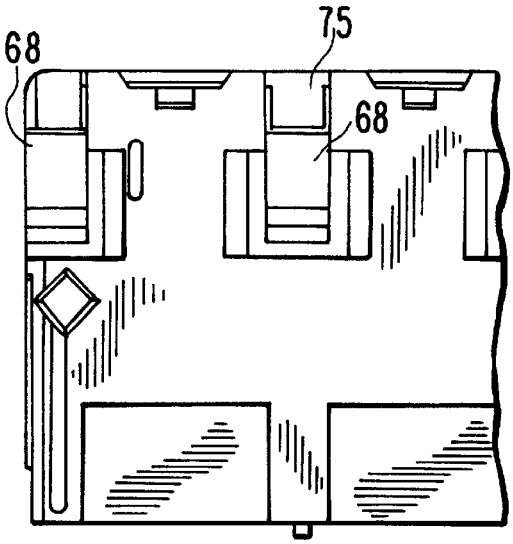
FIG.9B
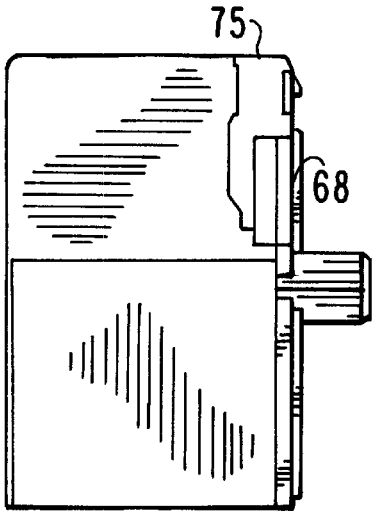
FIG.9C

LIGHT PIPE FOR A MODULAR JACK

BACKGROUND OF THE INVENTION

Modular jack receptacle connectors mounted to printed circuit boards (PC boards) are well known in the telecommunications industry. These connectors are typically used for electrical connection between two electrical communication devices. In order to ensure that a proper connection has been made and therefore that a link is created between the electrical communication devices, indicators such as light emitting diodes (LEDs) are often incorporated into circuits on the PC board to indicate that power is on or to indicate that an error has occurred in the transmission of signals. These LEDs were initially mounted on PC boards; however, in an effort to miniaturize PC boards and save PC board real estate, LED indicators have been integrated into the connectors.

An example of such a connector is disclosed in U.S. Pat. No. 4,978,317 to Porcrass which teaches a connector for receiving a plug which has a visual indicator positioned within the front wall of the electrical connector housing. Incorporation of the indicator into the connector eliminates the need for a separate location on the printed circuit board for mounting of such an indicator. The LED indicator is situated in a recess of the electrical connector with its electrical leads extending through the housing to connect to the printed circuit board. The indicator is secured in the housing using appropriate adhesive or mechanical means. LEDs may also be molded into the electrical connector during the manufacturing process.

Another approach to the above-described space problem is to incorporate a light guide or light pipe in the housing of the jack, which light guide extends from the front face of the housing to a bottom area of the housing generally adjacent an LED mounted on the PCB. Such a light guide is typically of a light transmitting plastic which has a light entry surface, a light reflecting surface for directing the light forward, and a light output surface at the front face of the housing. Further examples of prior art jacks and light pipes are disclosed in U.S. Pat. No. 5,876,239 to Scott F. Morin et al., U.S. Pat. No. 5,915,993 to Yakov Belopolsky et al., U.S. Pat. No. 5,613,873 to Joseph W. Bell, Jr., U.S. Pat. No. 5,741,152 to Kamal S. Boutros and U.S. Pat. No. 5,790,041 to Sherman Lee, which are incorporated herein by reference.

Space is a critical aspect in state-of-the-art connectors of the type considered herein. The space available for the light guide within the housing is highly limited, as is the vertical height of the light-viewing window in the front wall of the connector. This becomes a particular problem where an LED on the PC board contains a pair of light-emitting chips spaced axially in the rear-to-front direction. The limited height available for the light pipe may result in inadequate light transmission from the LED to the front window. One factor causing space problems is the forty-five degree inclination of the rear reflecting surface in a basic rectangular block prior art light pipe. With this shape the maximum cross-section for light transmission is established. If the length of the light emission area of the LED is relatively long, particularly with the dual light emitting chips on a single LED, some light from one or both of the light chips will be lost and thus not communicated to the front window. A light guide with a greater height would solve this problem; however, such additional height is usually not available. The present invention provides a novel and effective solution as explained below.

SUMMARY OF THE NEW INVENTION

This invention is a new modular jack having a novel light pipe incorporated therein and this jack in combination with the PC board. The invention further includes the new light pipe alone for use in other modular jacks and a new method of transmitting light from an LED to a light-viewing window in the jack. A first objective herein is to transmit light from an LED on the printed circuit board to the front face of a modular jack housing. It is desired to reduce loss as light is transmitted from the light source to the destination which is typically a window in the jack. A further objective is to overcome the space problem that now exists when using modular jacks on printed circuit boards. Space is critically limited on the PC boards, on the face of the jacks and in the height dimension within the connector perpendicular to the face of the PC board. Where a light pipe is used within a jack, manufacturing tolerances require allowance of specific clearance space to separate the LED from the light pipe. This consumes still further space of the PCB and jack assembly. This invention thus seeks to integrate in a new way, light indicator technology, modular connectors and PC boards to reduce space use, minimize light loss, and enhance light transmission.

The above objectives have been achieved in the present invention by a novel and unusual light guide or light pipe whose configuration allows enhanced light transmission in a reduced size. In a particular embodiment the new light guide allows light from an elongated LED to be captured and directed to a window in the front face of the jack. This is achieved in part by a series of notches or channels extending transversely across the top and/or bottom walls of the light pipe, which create a plurality of additional light reflection surfaces. Light from the LED is directed to these various reflection surfaces and thence via various paths to the illuminated window to indicate on/off conditions of respective circuits. These notches allow more light from a greater source area to be captured with a smaller light pipe, this light then being directed to the front indicator window on the modular jack. These new notches or surface channels and resulting new reflection surfaces reduce light loss and help to overcome space constraints created where a modular connector is coupled to a PC board.

In one preferred embodiment of this invention one or two notches are established in the top wall of the light pipe to create respectively one or two primary light reflection surfaces. A notch in this configuration means a channel or groove or beveled surface extending transversely across the light pipe between its sides. Each notch results in a surface defining an acute angle with respect to the longitudinal axis of the light pipe. Light directed onto such reflection surfaces will be reflected generally in the axial direction to the front end of the pipe where it will be visible through the window in the jack's front wall or through the window in the front shield at the front of the jack.

In another embodiment of this new invention it is possible to use a light pipe having height perpendicular to the plane of the LED that is less than the length of the LED in the axial direction of the light pipe, and to still capture the available emitted light with a minimum of loss, and to direct or focus the captured light to the window which also has height less than the axial length of the LED.

BRIEF DESCRIPTION OF THE DRAWINGS

FIG. 9 is a fragmentary front elevation of the body part of FIG. 7; FIG. 9B is a bottom pan view of FIG. 9A; and FIG. 9C is a right side elevation of FIG. 9B;

DETAILED DESCRIPTION OF THE PREFERRED EMBODIMENTS

Figure 1:
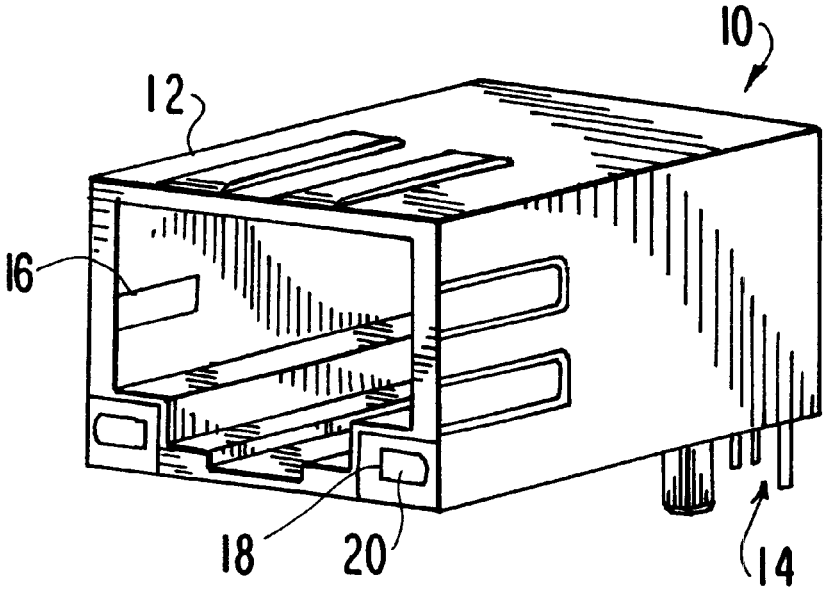
FIG. 1 is a front perspective view of a first embodiment of a new modular jack.
Figure 2:
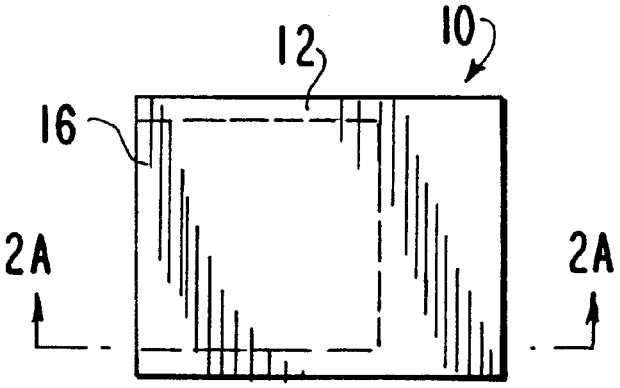
FIG. 2 is a top plan view thereof.
Figure 3:
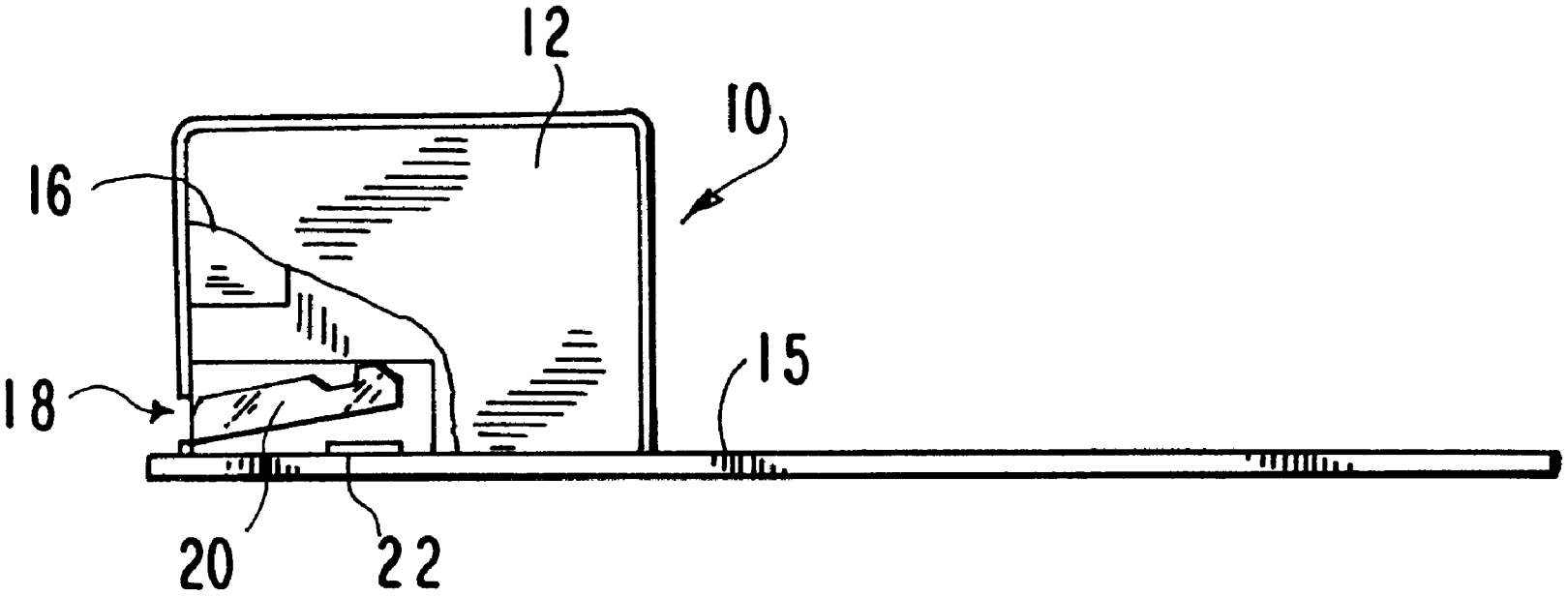
FIG. 3 shows schematically a modular jack of FIG. 2A coupled to a PC board.

FIGS. 1–3 show schematically a first embodiment 10 of the new modular jack including its housing 12, pins 14 for mounting this jack to a PC board 15, a principal recess 16 for receiving a plug at the terminal end of a cable (not shown), and a window 18 behind which is the front visual display surface or light indicator zone of the new light pipe 20 which will be illuminated to indicate the status of selected circuitry.

The housing 12 is a generally rectangular structure which is readily made of molded plastic by methods well known in the industry. Within recess 16 are electrical contacts (not shown) connectable to mating contacts on a plug inserted in the recess.

While the overall structure of the jack is known in the prior art, the novelty of this invention lies with the new light pipe 20, its configuration and integration into a jack and its cooperation with an LED on a PC board. FIGS. 2*a*–2F show in cross-section various aspects of a first embodiment of the new light pipe 20 as explained below.

Figure 2A:
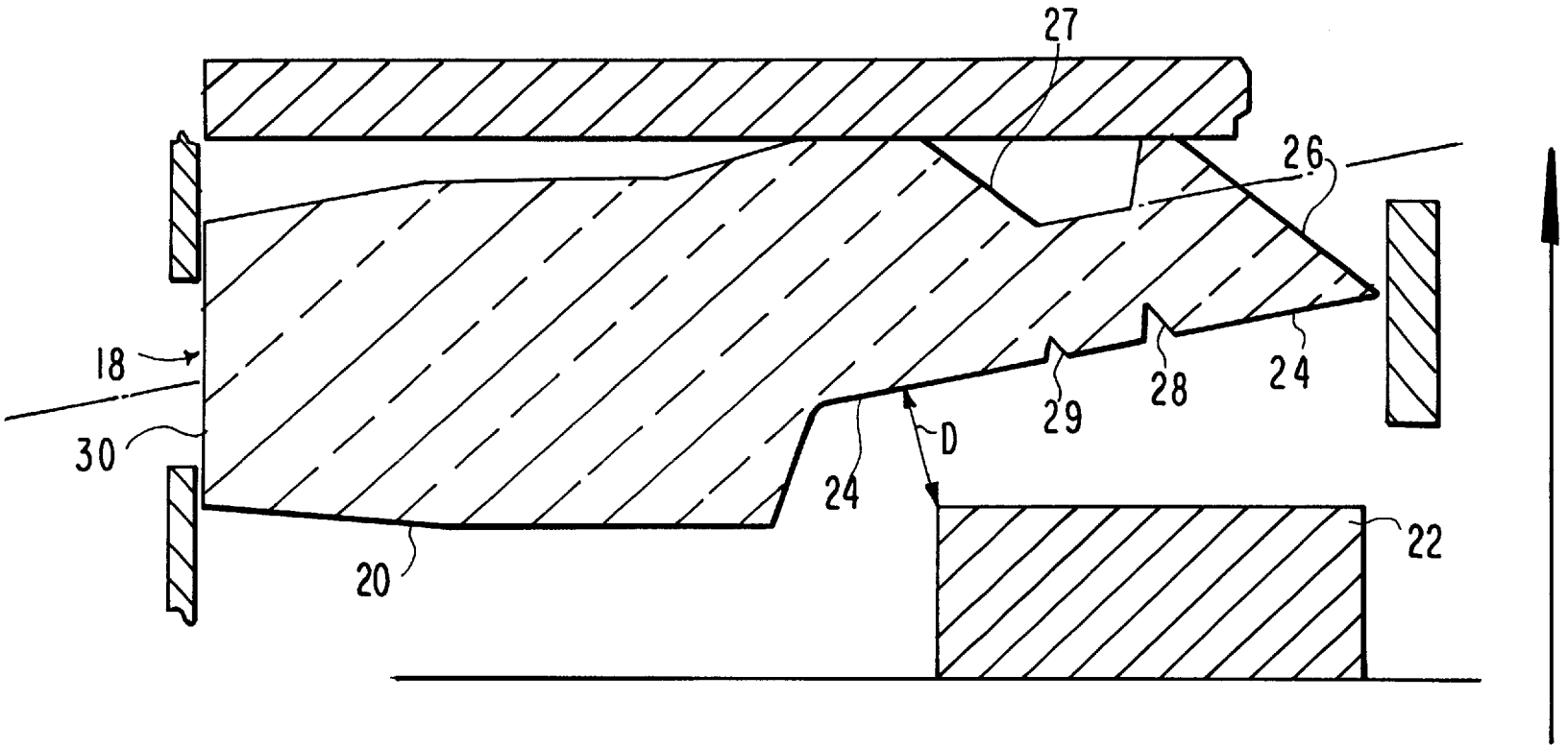
FIG. 2A is a schematic sectional view taken along line 2A—2A of FIG. 2.

In FIG. 2A the light pipe 20 is seen as an elongated body of plastic such as polycarbonate which has high light transmission capability or other suitable plastic mounted within said housing. This body has a longitudinal axis X—X in the direction of rear-to-front, and has top, bottom, front, rear and side surfaces. The bottom rear surface 24 receives light emitted from LED 22. As further seen in FIG. 2A reflection surfaces 26, 27, 28 and 29 receive and redirect portions of light from the LED forward to light indicator surface 30 which becomes illuminated and visible through window 18. FIG. 2A further shows a dimension line D indicting the minimum distance between the LED and the light pipe. Typical manufacturing tolerances require this distance to be at least 0.030 inches. Thus, the light pipe cannot be situated flat against the LED or flat against the PC board. The various reflection surfaces will now be considered in detail.

Figure 2B:
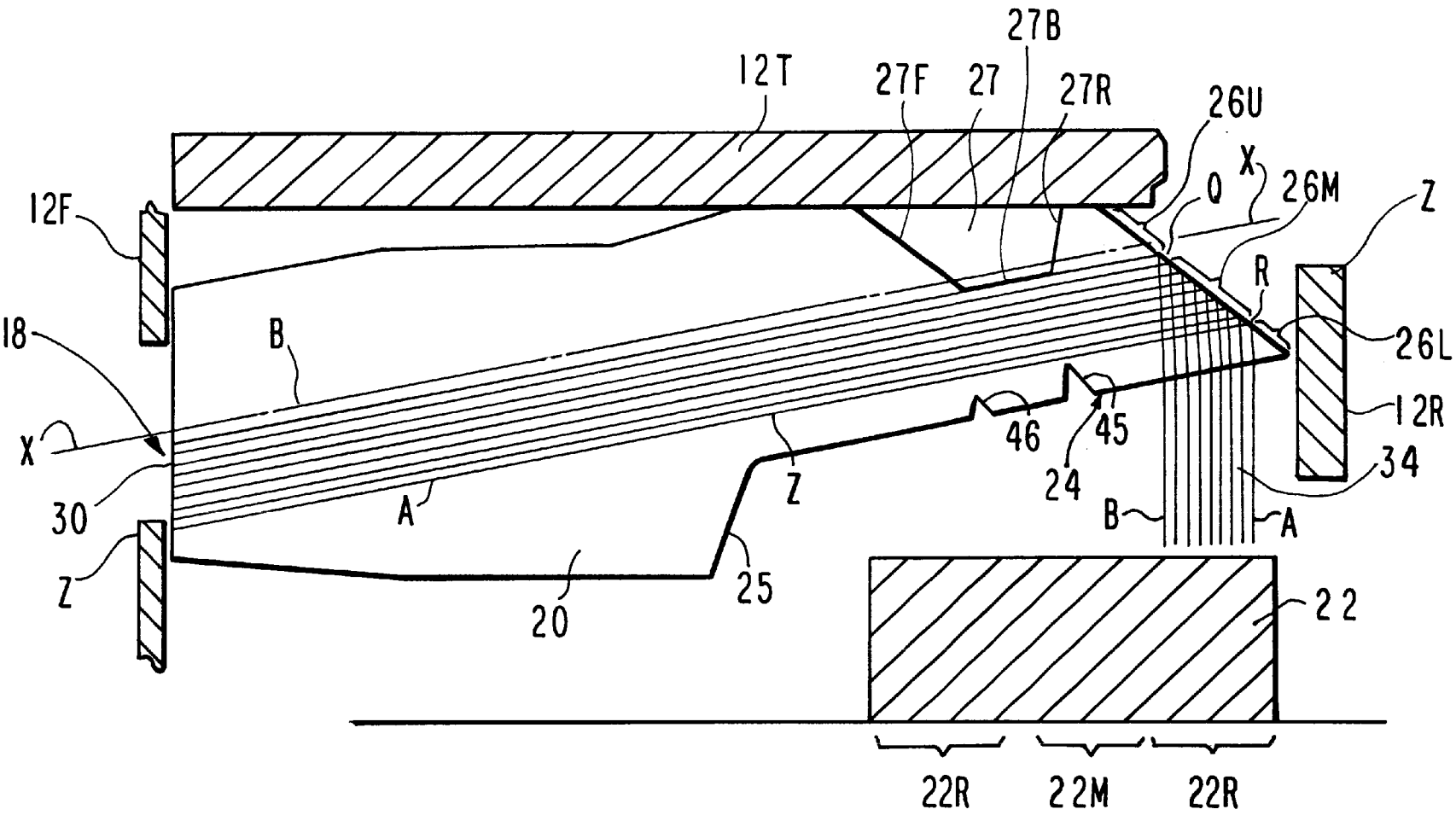
FIG. 2B is similar to 2*a* but shows primary light reflection from the LED off only the first notch reflection surface.
Figure 17:
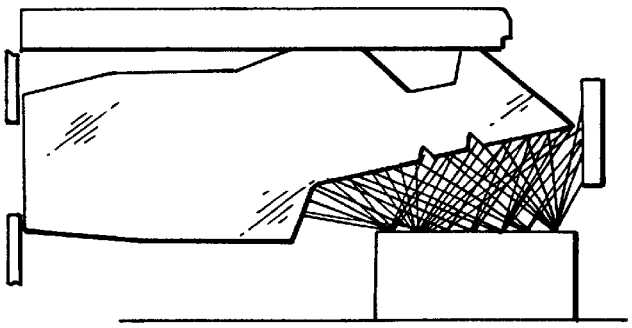
FIG. 17 is a schematic elevation view of an LED and a light pipe.

FIG. 2B, like FIG. 2A, shows housing 12 containing light pipe 20 with its longitudinal axis X—X. A cavity is provided at the rear of the housing to receive LED 22 which emits light upward to the light pipe's light-receiving refraction surface 24. For purposes of simplicity and clarity of presentation the light emanating from the LED and traversing the light pipe is illustrated as parallel lines in typical textbook fashion; however it is obvious that the light in reality emanates in a multitude of upward angled directions as seen in FIG. 17. Thus, some light rays enter the refraction surface and are refracted and reflected at angles other than as shown. For this reason, and because of imperfections in the light pipe material and its surfaces and due to internal flow lines, there will be substantial internal reflections and ultimate illumination at the light viewing window 18.

In the example of FIG. 2B the LED 22 has rear, middle and front parts 22R, 22M and 22F respectively. Thus, light bundle 34 is emitted from the rear portion 22R of LED 22. This light, when traversing surface 24, is slightly bent by refraction and directed to reflection surface 26 where the angle of incidence equals the angle of reflection pursuant to well-known principles of optics.

As seen in the schematic representation of FIG. 2B, light bundle 34 has rear and front rays a and b respectively which ultimately are reflected to the light indicator surface 30 at the lower half of light-viewing window 20. It should be noted that this light bundle 34 strikes reflection surface 26 in a middle region 26M thereof; upper and lower regions 26U and 26L will be discussed later. Suffice it to say that rear light bundle 34 from the rear portion 22R of the LED utilizes a middle portion 34M of the reflection surface 26 and strikes the lower half of the front surface 30 of the light pipe.

Figure 2C:
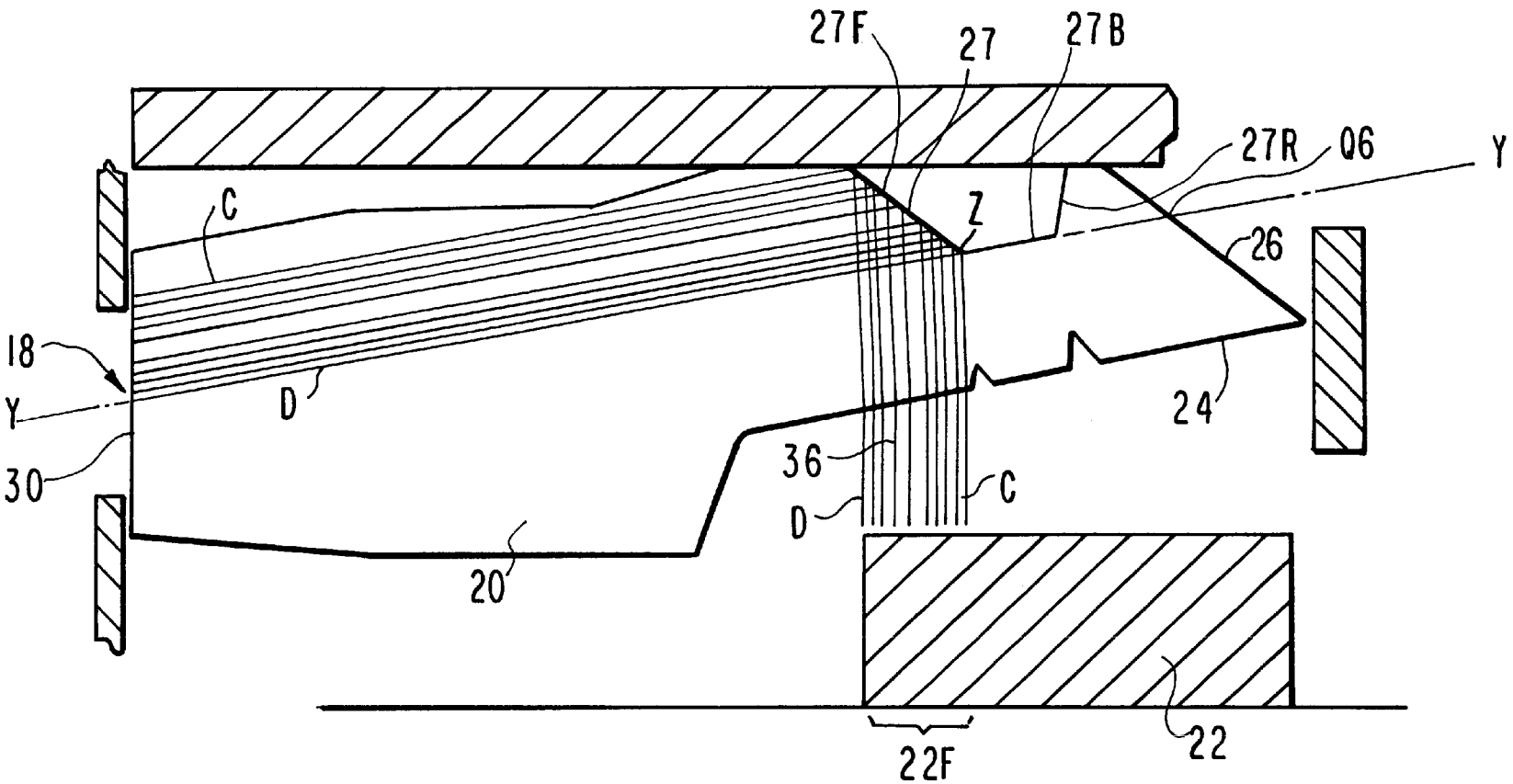
FIG. 2C is similar to 2B but shows primary light reflection from the LED off only the second notch reflection surface.

To help clarify the various optical paths followed by various light ray bundles, reference is made to symbolize first and second separation planes Y—Y and Z—Z which are introduced merely to illustrate more clearly a demarcation between light ray bundles. FIGS. 2A–2F show a channel or notch 28 extending transversely across the top surface of light pipe 20 between its opposite sides. This channel is defined by a front wall 27F which functions as the second primary reflection surface, rear wall 27R and bottom wall 27B. As seen in FIG. 2C relevant light rays c–d emanate from area 22F on the LED and strike wall 27F. Ray c is reflected at a point where wall 27F intersects wall 27B. Through this line of intersection of walls 27F and 27B extends said first separation plane represented by line Y—Y in FIG. 2C, which plane extends transversely between the opposite sides of the light pipe. Plane Y—Y intersects the first reflection wall 26 along line Q shown as a point in FIG. 2C. FIGS. 2B, 2C and 2F all show point Q. FIGS. 2C and 2F show that light bundle 36 when reflected by wall 27F is situated above plane Y—Y, and light bundle 34 when reflected by reflection zone 26M (FIG. 2B) is situated below plane Y—Y. These two light bundles 36 and 34 are then directed in parallel to light indicator zone 20F.

Further clarififying the light ray paths is symbolic separation plane Z—Z which intersects rear reflection zone or wall 26 at point or line R in FIGS. 2B and 2F. The light bundle 34 strikes surface 26 from point Q down to point R which lies in plane Z—Z. Below plane Z—Z is a region for reflection of light ray bundles 38 and 39 as seen in FIGS. 2E and 2F.

FIG. 2C shows front light bundle 36 of rays c-d emitted from the front portion 22F of the LED to refraction surface 24 and thence to the second primary reflection surface 27 which is parallel to the previously-described first reflection surface 26. Thus, light bundle 36 is reflected parallel to light bundle 34 until it strikes the front light indicator surface 30 at the lower half thereof.

Figure 2D:
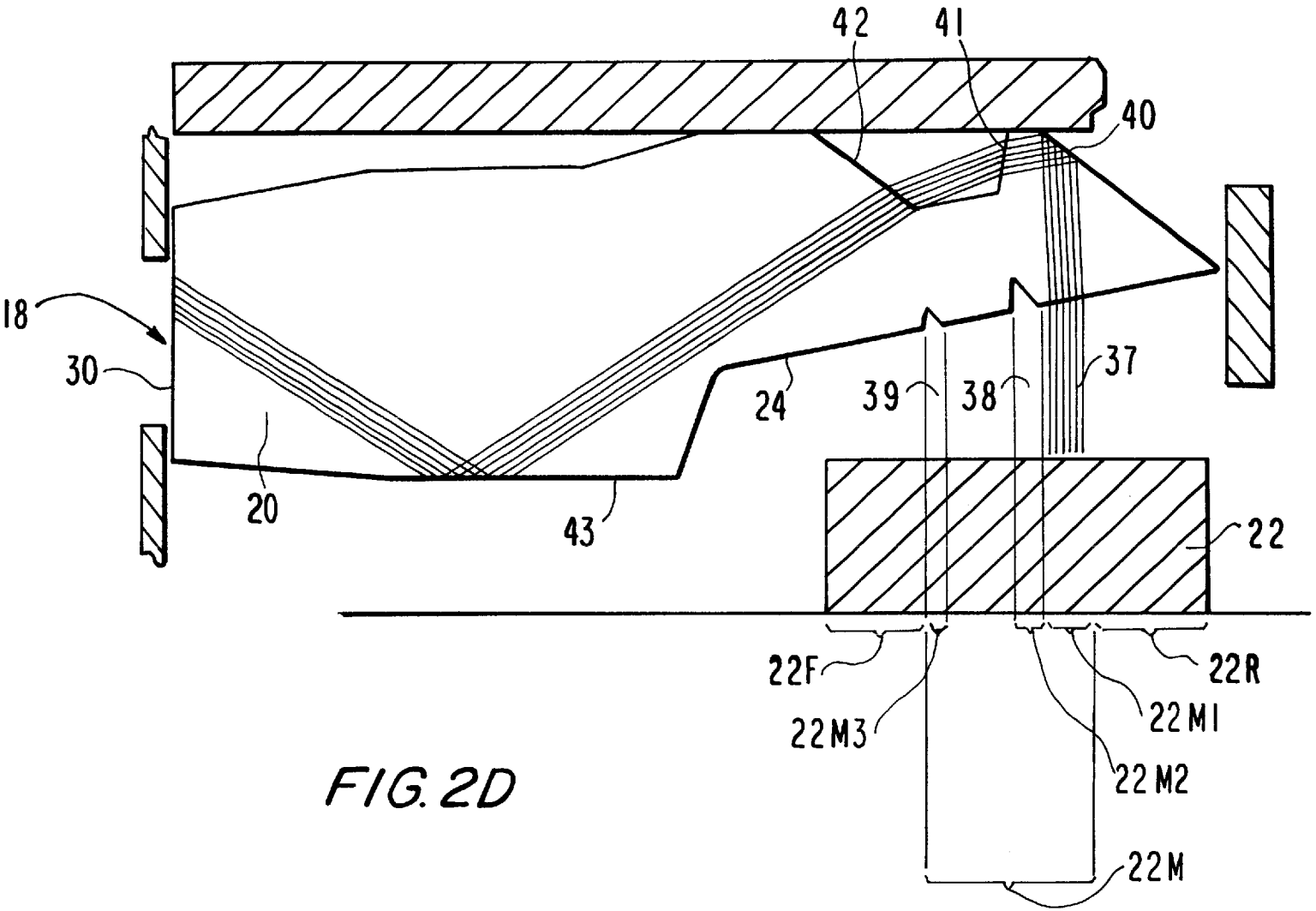
FIG. 2D is similar to 2C but shows secondary light reflection from the LED off only the first notch reflection surface.
Figure 2E:
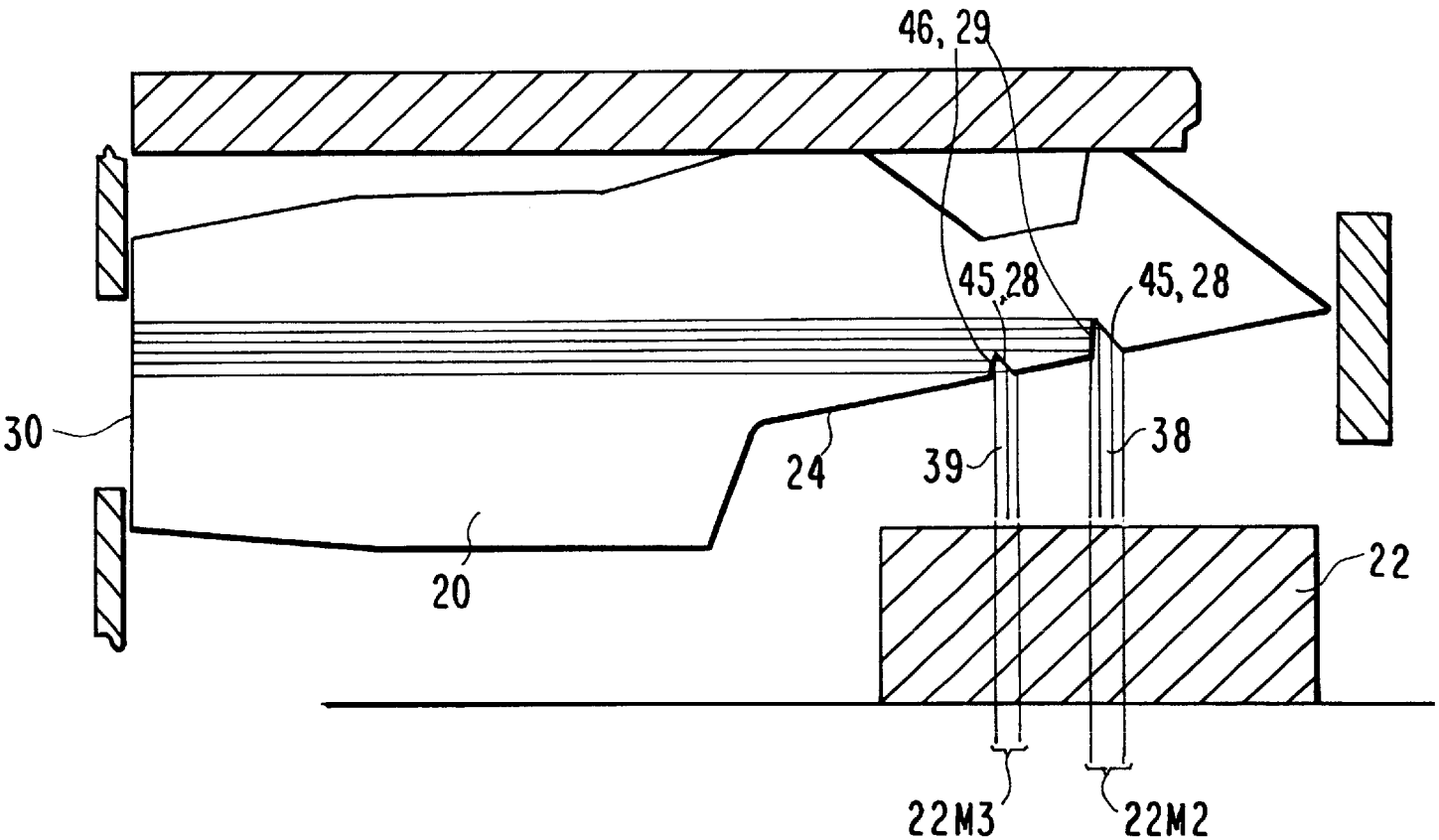
FIG. 2E is similar to 2D but shows secondary light reflection from the LED off only the third and fourth notch reflection surfaces respectively.
Figure 2F:
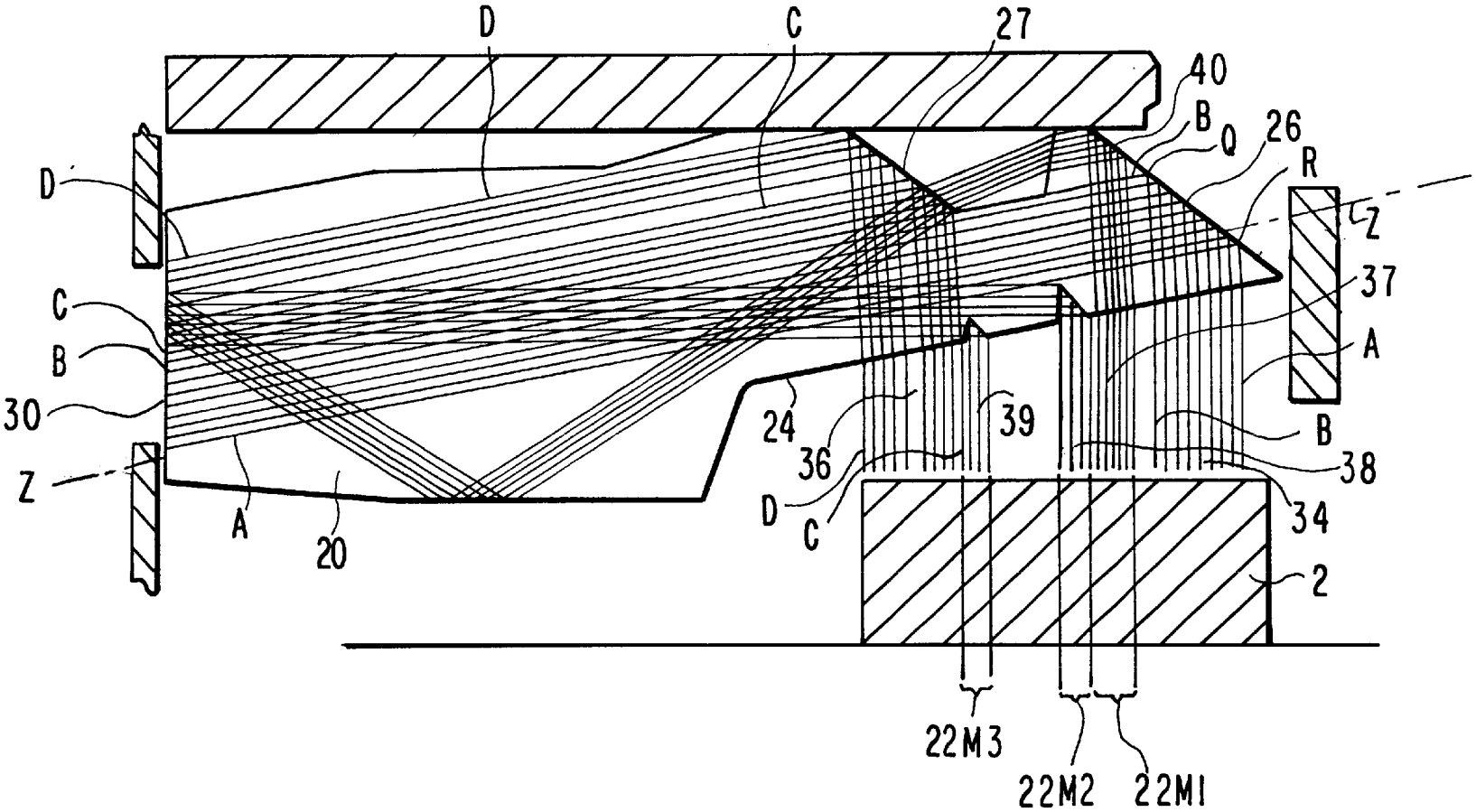
FIG. 2F is similar to 2E but shows primary and secondary light reflections simultaneously off all the first through fourth notch reflection surfaces.

FIGS. 2D and 2E show reflection of three additional light bundles, and FIG. 2F shows reflection of all the light bundles simultaneously. In FIG. 2F light bundles 34 and 36 comprising rays a–b and c–d are shown to range over the full height of the light exit surface 30; however, the final illumination is established from the combination of all the light bundles in addition to bundles 34 and 36.

Returning now to FIGS. 2D and 2E, the light-emitting surface of the LED 22 is divided into rear area 22R, front area 22F, and middle area 22M, the latter being further subdivided into areas 22M1, 22M2 and 22M3 which produce emitted light bundles 37,38 and 39 respectively. In FIG. 2D light bundle 37 is refracted to secondary reflection zone 40, thence through refraction surfaces 41 and 42, thence to reflection zone 43 and finally to light indicator zone 30.

FIG. 2F shows how light bundles 38 and 39 are reflected to the light indicator zone 30 via notches compromising reflection on surface 28 and 29 and refraction surfaces 45 and 46 respectively cut in the refraction surface 24. These notches extend transversely across the light pipe between its side walls. Obviously, these notches are positioned to correspond to the axial locations and spacing of the corresponding light-emitting surfaces of light bundles 38 and 39 of the LED 20.

Reviewing FIGS. 2A and 2F it can be seen that the two primary reflection surfaces 26 and 27 are axially spaced rearward and forward respectively. This corresponds to rear and forward light emitting zones or chips on the LED 22, such that the light pipe 20 can transmit separate light bundles from these separate light sources to produce separate light displays, which may be different colors on front light display surface 30.

It can now be seen from FIG. 2F that a large percentage of the emitted light from the LED is captured by the light pipe and directed to the light indicator zone 30, and this is achieved with a light pipe having a relatively low height dimension between its light entry surface 24 and its top surface. Thus, we have enhanced light transmission with a reduced space requirement, and use of an extremely simple single-element light pipe element.

Figure 4:
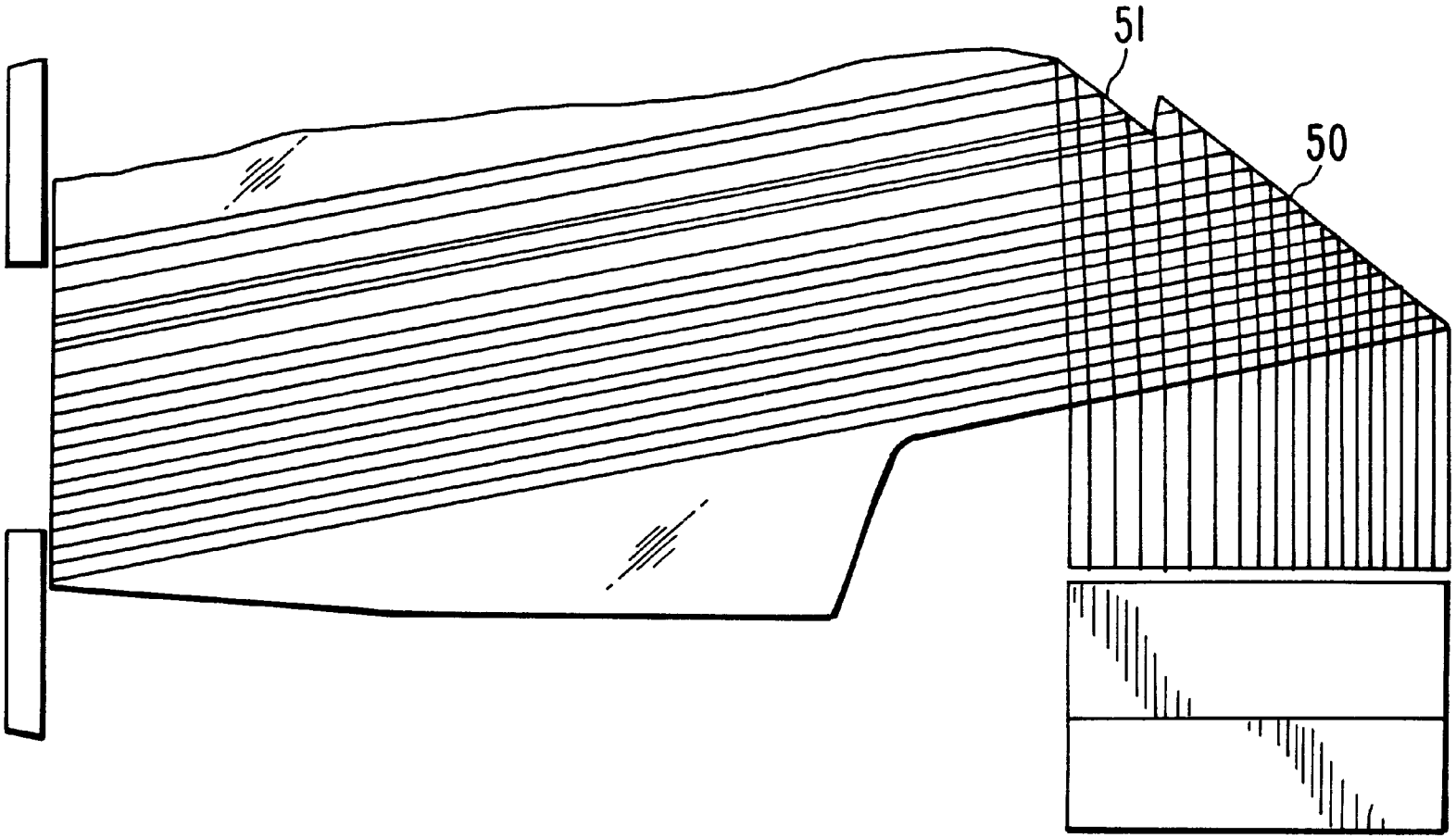
FIG. 4 shows the light reflection resulting from a combination of FIGS. 2B and 2C.

FIG. 4 shows schematically the result from a light pipe having only the two primary reflection zones 50 and 51. For an LED with a single light chip the front-to-rear length is less than a dual light chip LED, so the light pipe with only primary reflective surfaces, as shown is suitable.

Figure 5:
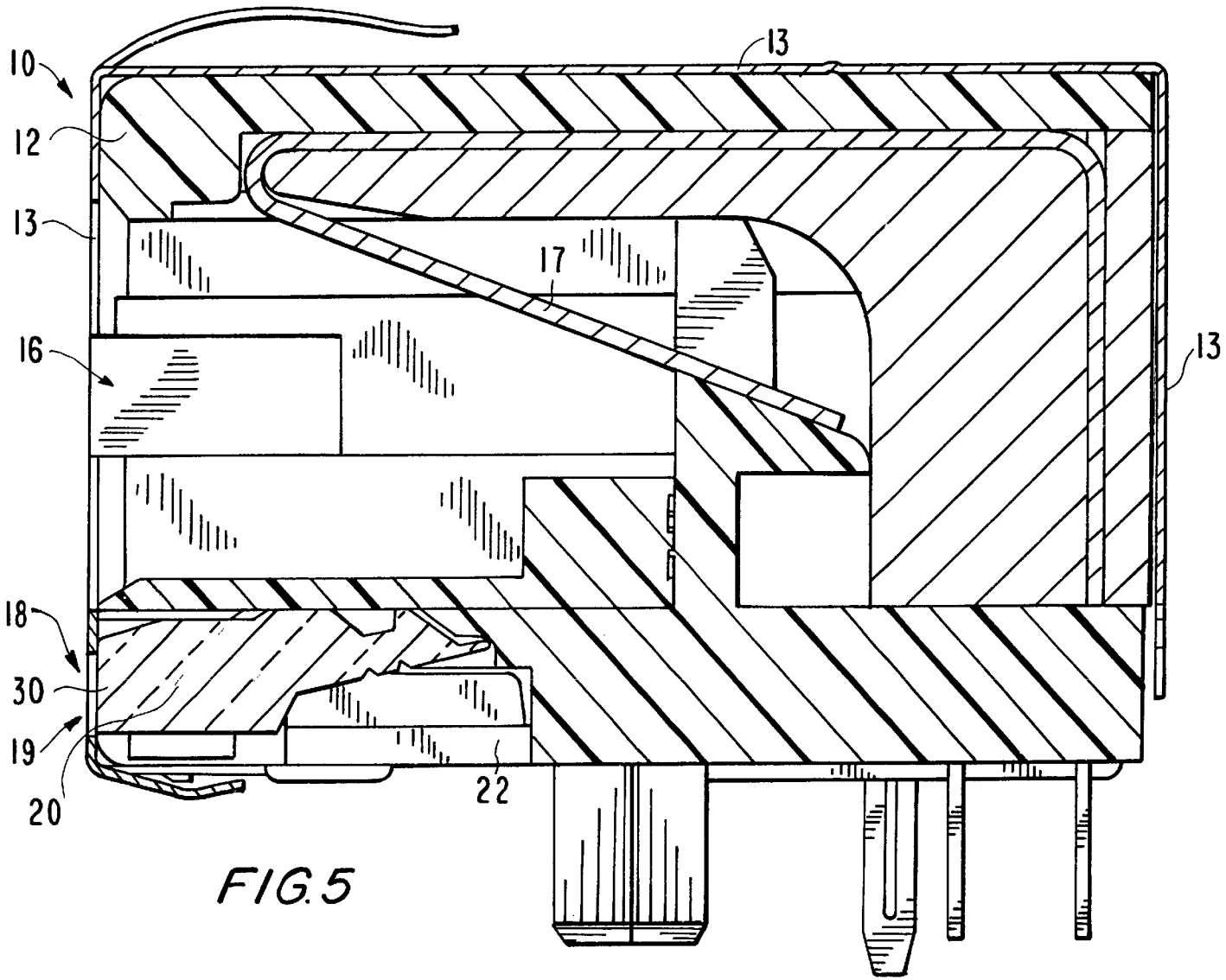
FIG. 5 is similar to FIG. 2*a*, but shows a more complete sectional view of a modular jack.

FIG. 5 shows in sectional view the structure of the new modular jack of the prior figures. In summary, this figure shows jack 10 having body 12, EMI shield layer 13 at the front, top, rear and sides, cavity 16 with resilient electrical contact strip 17 therein for receiving a plug, and cavity 19 whose front part contains the light pipe 20 and whose rear part receives the surface-mounted LED 22. Adjacent the front face or light indicator-surface 30 of the light pipe is window 18 in the shield. The body 12 of this device is made of polycarbonate, the shield and remaining components are made of materials and by techniques well known in this art.

Figure 6:
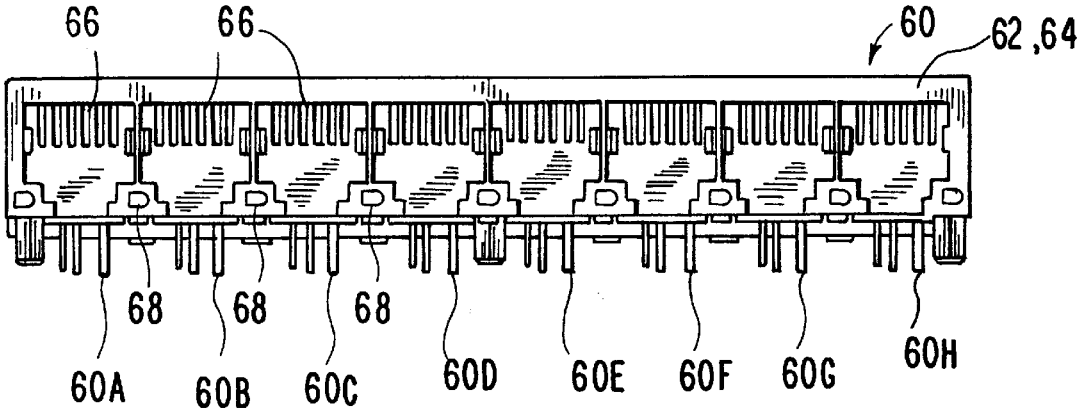
FIG. 6 is a front elevation view of a multiple modular jack connector formed of a body part and encasing shield.
Figure 7:
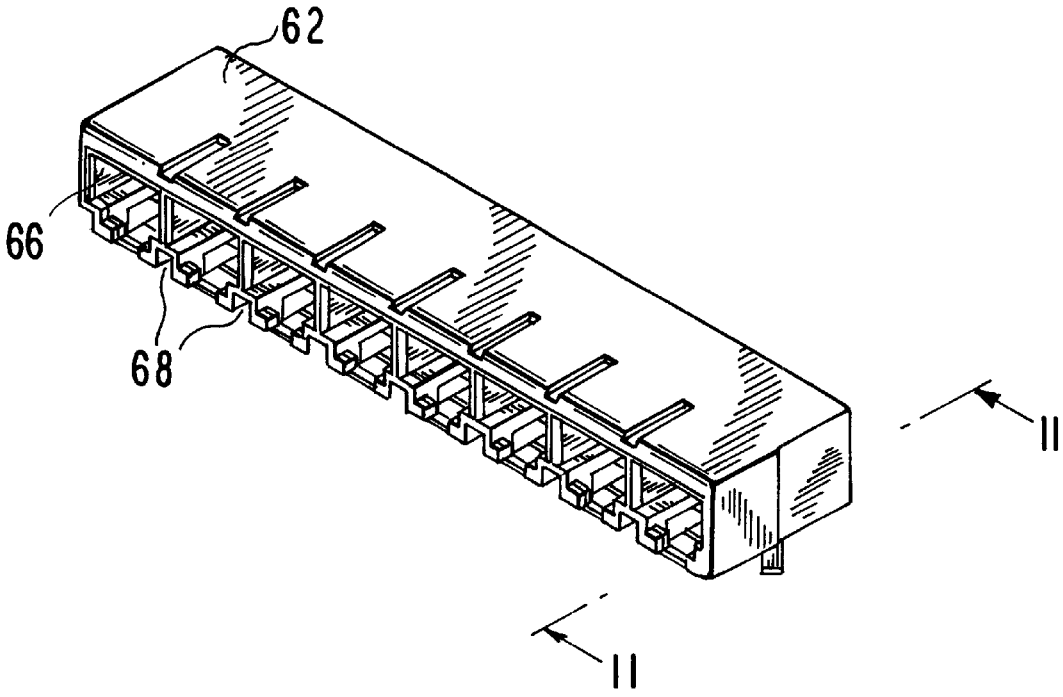
FIG. 7 is a front perspective of the body part of the multiple modular jack connector of Fig.6.

A second preferred embodiment is a multiple modular jack 60 as illustrated by FIGS. 6–16. FIG. 6 shows the assembled multiple jack as constructed of a molded one-piece body part 62 further seen in FIG. 7, an encompassing sheet metal shield 64 further seen in FIG. 8, and a light pipe 20 as also seen in FIGS. 3 and 5. This particular jack has eight aligned cells 60A–60H; however numerous other numbers of cells could be chosen. Between each two adjacent plug receiving recesses 66 is a recess 68 opening frontward and downward to receive and hold a light pipe.

Figure 8:
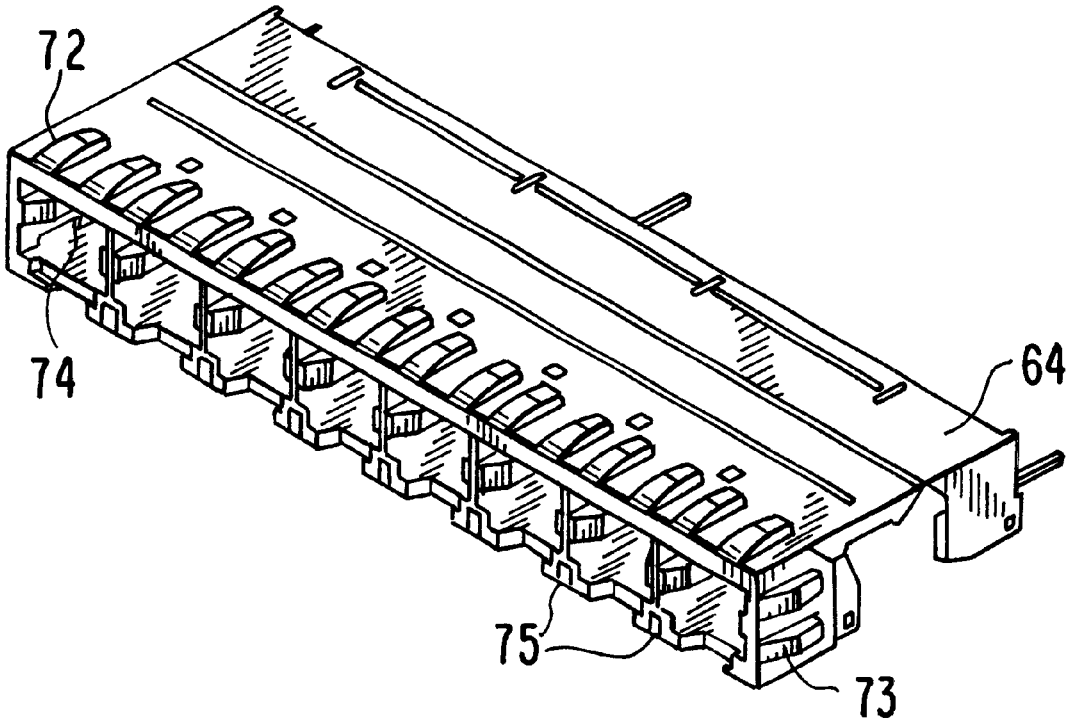
FIG. 8 is a front perspective view of the sheet metal shield that encases the body part of FIG. 7.

FIG. 8 shows the sheet metal shield which in this case is a single sheet cut, punched or otherwise formed to define and include walls, resilient fingers 72, 73, openings or windows 74 to overlie the front recesses 66 of the body 62, and further windows 75 to expose the light exit surfaces of the light pipes.

Figure 10:
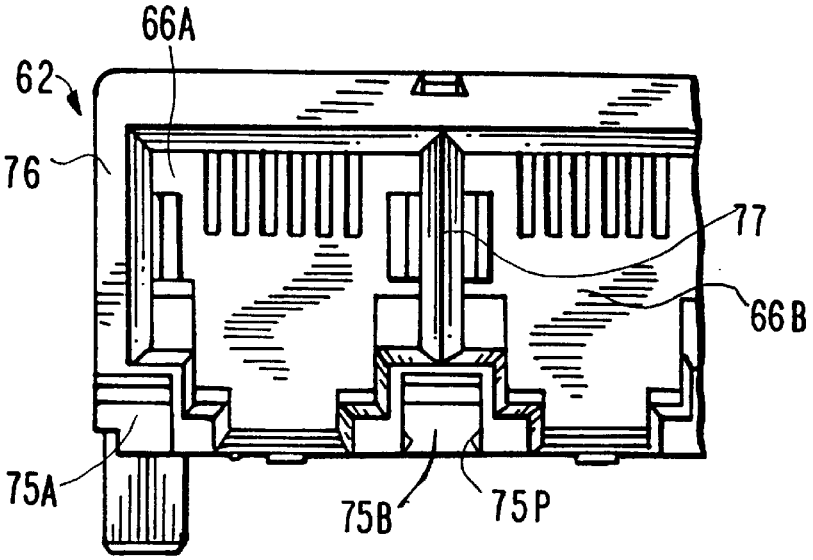
FIG. 10 is a fragmentary enlargement of a single receptacle unit of the multiple jack of FIG. 6.

FIGS. 9A–9C and 10 show details of the structure of the body 62, which include outside wall 76 and divider wall 77 separating and defining adjacent front recesses 66A and 66B in FIG. 9A. In the bottom plan view of FIG. 9B and the side elevation view of FIG. 9C, the recess 68 to accommodate the light pipe is more clearly shown. FIG. 10 shows more clearly window 75B to expose the illuminated front end of the light pipe associated with recess 66B, while window 75A relates to recess 66A. Projections 75P engage and help secure the light pipe in position.

Figure 11:
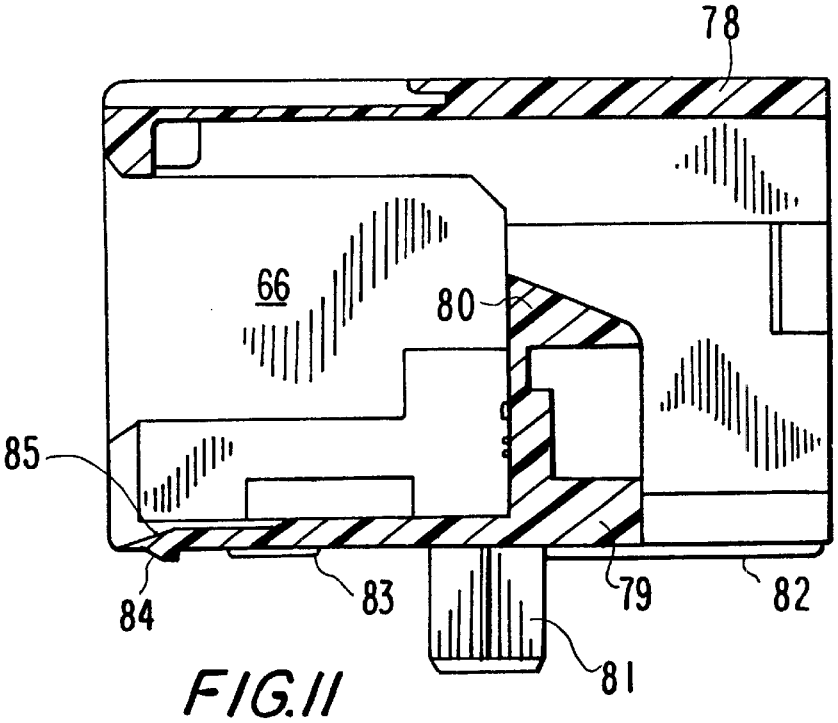
FIG. 11 is a sectional view taken along line 11—11 of FIG. 7.
Figure 13:
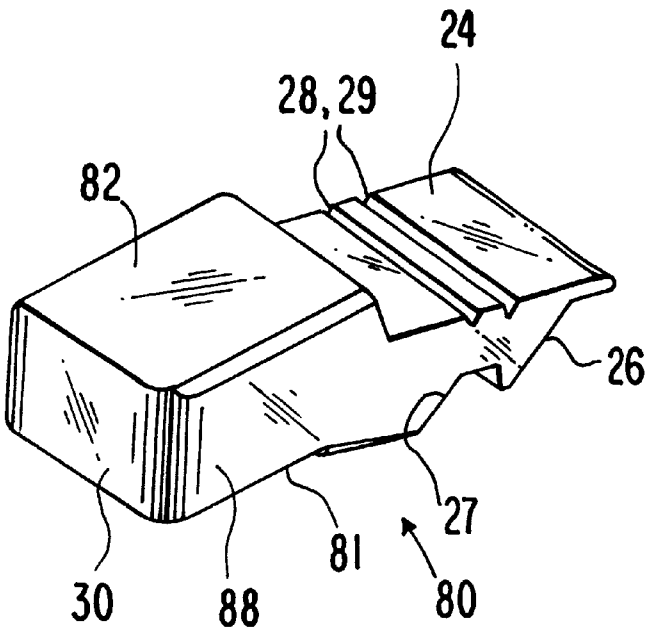
FIG. 13 is a bottom front perspective view thereof.
Figure 12:
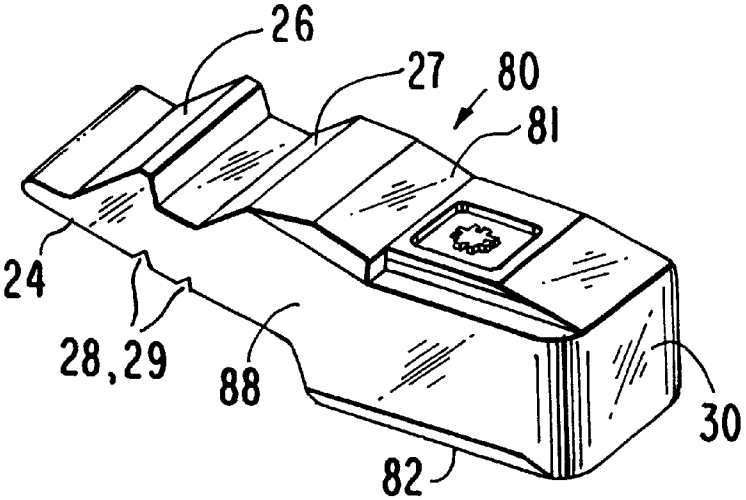
FIG. 12 is a top, front perspective view of the new light pipe.

FIG. 11 is a sectional view of the new jack showing top wall 78, bottom wall 79, rear wall 80, positioning pin 81, wash-out rails 82, 83 and front tab 84. The recess 66 includes a tapered bottom entry surface 85.

FIGS. 12–16 illustrate further details of the preferred embodiment of the light pipe which is essentially the same as was previously shown in FIGS. 2A–2F, 3, 4 and 5. To simplify this description FIGS. 12–16 some of the same reference numbers will be used for corresponding features. In FIGS. 12–16 light pipe 80 has top surface 81, bottom surface 82, light entry refraction surface 24, first primary reflection or notch surface 26, second primary reflection or notch surface 27, secondary refraction surfaces 28, 29 light exit surface 30 and sidewalls 88.

Figure 14:
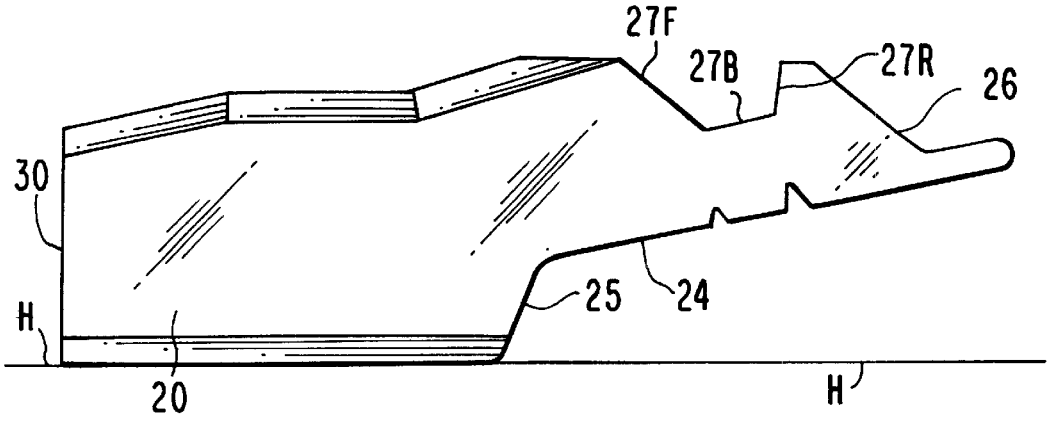
FIG. 14 is a side elevation view thereof.
Figure 15:
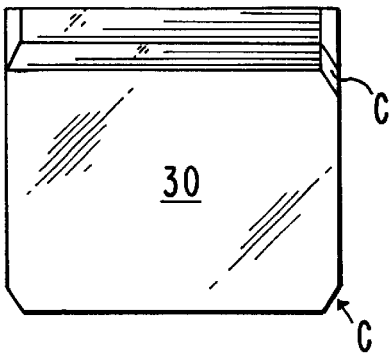
FIG. 15 is a front elevation view thereof.
Figure 16:
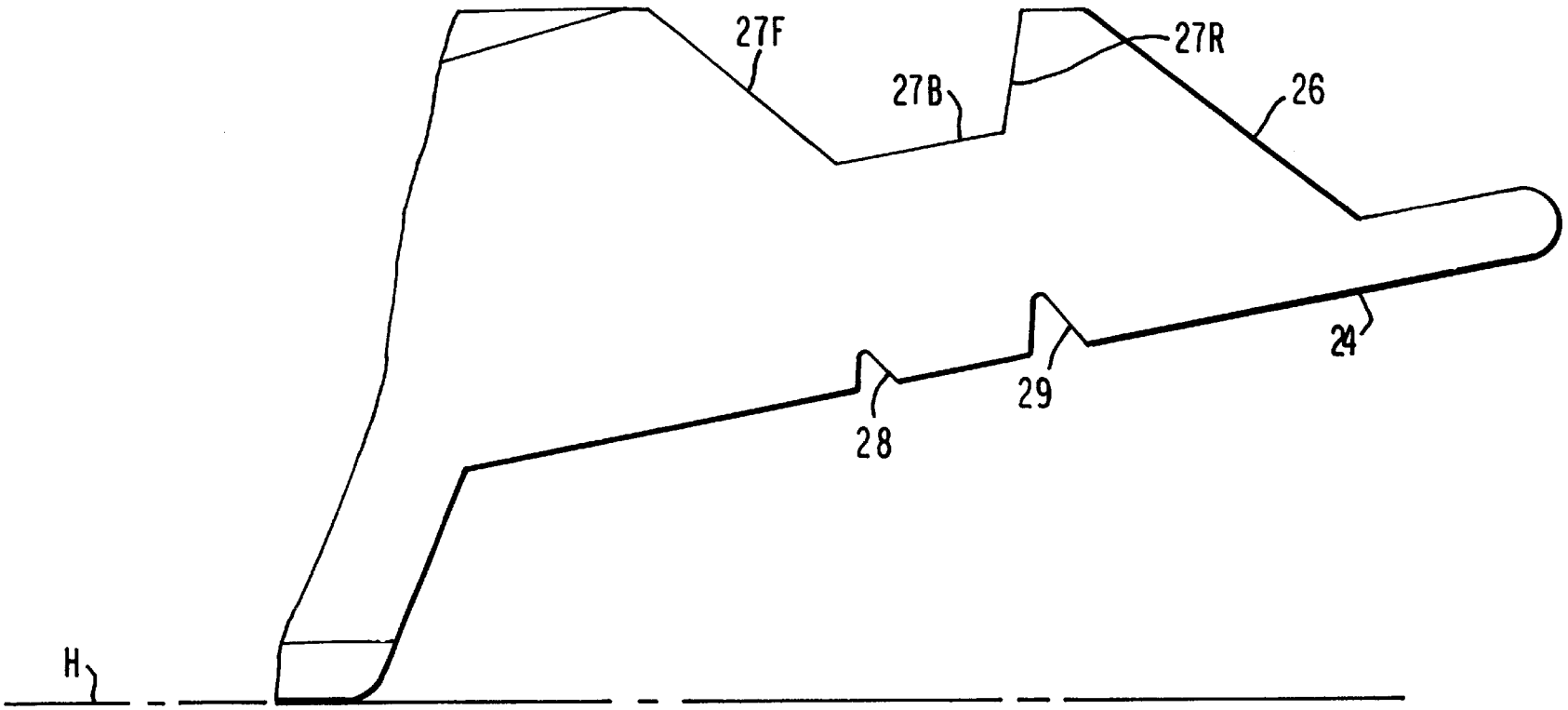
FIG. 16 is a fragmentary enlarged elevation view of the rear approximately one half of the light pipe of FIG. 12.

The light pipe configuration of FIGS. 14–16 may be defined with respect to a number of different reference planes. For convenience and easy understanding the horizontal plane H—H in FIG. 14 will be used as the starting reference plane. The light entry or refraction surface 24 is inclined 11° upward and rearward with respect to plane H—H. Shoulder surface 25 is inclined 112° with respect to plane H—H. The enlarged view of this light pipe in FIG. 16 shows that reflection surface 27F at the upper notch is 132° inclined with respect to surface 27B which is parallel to surface 24. Refraction surface 27R is 8° inclined relative to a vertical reference plane that is perpendicular to horizontal plane H—H The primary reflection surface 26 is 49° inclined relative to refraction surface 24, and finally the bottom notches 28, 29 are inclined 56° from said refraction surface 24. FIG. 15 shows chamfer edges C at the top and bottom of this light pipe.

FIGS. 14–16 show further details of the light pipe shape, configuration and angular measurements. With the magnitude of dimensions shown a light pipe will be able to produce a "basic" light ray pattern as indicated in FIGS. 2B–2F. As noted earlier, such basic pattern represents idealized light rays emanating only parallel and vertically from the LED. In reality light will traverse and reflect in the light pipe in a multitude of directions as seen in FIG. 17. Because light enters the light pipe from many angles, its ultimate configuration may vary considerably while still directing the light to the forward viewing surface.

Appended hereto is an Appendix I including calculations and diagrams which explain and demonstrate the shape and dimensions of the light pipe described above. This Appendix begins on page a with the "Law of Reflection," which is followed by "Refraction of Light" and then "Total Internal Reflection." Page b shows "LitePipe Design Theory" and "Conclusion." Page c shows "Snell's Law of Refraction." Page d provides a first chart showing refraction of light from air into Lexan® according to Snell's Law of Refraction. Pages e–f provide a second chart showing refraction of light from Lexan® into air. Pages g–h show graphic representations of light transmission:

a) air-into-Lexan® fraction, b) internal reflection, c) Lexan®-into-air refraction, and d) air-into-Lexan® refraction Appendix II provides specifications for a commercially available LED as used with this light pipe.

Figure 18:
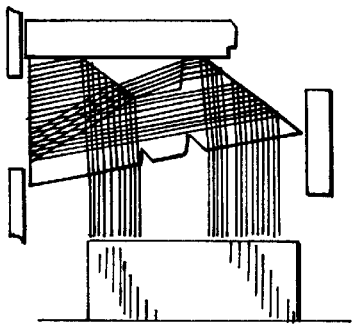
FIG. 18 is a schematic elevation view similar to FIG. 2F, but of a short light pipe.

It should be apparent that the light pipe may vary in configuration while remaining within the scope of the present invention. Not only can the inclination of reflection and refraction surfaces vary, the principal longitudinal axis, which in this case is parallel to light surface on plane 24, may vary. Also, the entire light pipe is seen in FIG. 14 could be foreshortened as seen in FIG. 18. In this new configuration the reflected light (as seen in FIG. 2B for example) would travel less distance and thus be less descended at the light exit surface. For this embodiment, either the light viewing window in the front surface of the jack would be elevated as done in FIG. 1 8, or the light pipe could be adjusted in configuration to produce the desired light paths. Here, there are still multiple reflection surfaces which is particularly useful when using a dual chip LED.

Figure 19:
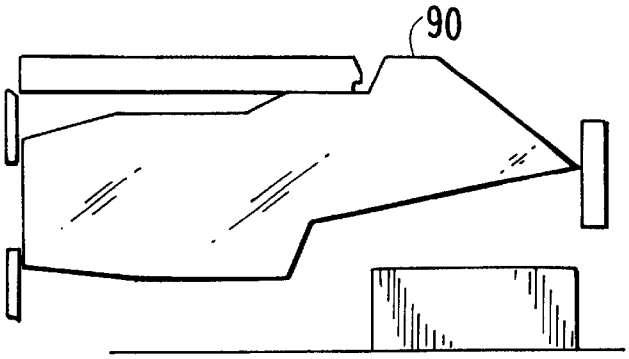
FIG. 19 is a schematic elevation view similar to FIG. 2F, but having an outward protrusion in place of an inward notch.

A still additional variation of the new light pipe is seen in FIG. 19 where the upper notch is inverted into a hump 90. This results in one primary reflection surface without the double refraction stages seen in FIG. 2D, but with a greater overall height of the light pipe.

Although the preferred embodiments of the invention have been described with sufficient particularity to enable a person skilled in the art to make and use the invention without undue experimentation, it will be appreciated that numerous other variations and modifications of the illustrated embodiments may be made. Thus the description of this invention and illustrations thereof are not to be taken as limiting, but rather it is intended that the invention should be defined solely by the claims appended hereto.

What is claimed is:

1. A modular jack and PC board assembly comprising a PC board having a first surface with a surface mounted LED mounted thereon and a modular jack mounted to said first surface and overlying said LED, said LED having rear and forward light-emitting portions which emit rear and forward light ray bundles respectively, said jack comprising a housing having front, rear, top and opposite side walls and a bottom, said housing defining in said front wall a recess for receiving a plug with at least one electrical contact in said housing for electrical engagement with said plug when it is inserted into said recess and a window adjacent said recess, said jack further comprising a light pipe having a top, bottom, front, rear and side surfaces and having a light-entry zone in said bottom surface, a first light reflection zone in said rear surface, and light indicator zone in said front surface, and defining a longitudinal axis in the rear-to-front direction, said light pipe further comprising in its top surface a second light reflection zone situated forward of said first light reflection zone, said first and second light reflection zones positioned to receive said rear and forward light bundles respectively from said LED and to reflect said light bundles forward to said light indicator zone which is visible through said window.

2. An assembly according to claim 1 wherein said first light reflection zone defines a plane that is inclined forwardly and forms an acute angle with respect to said longitudinal axis.

3. An assembly according to claim 1 wherein said light indicator zone has height and said LED has in the axial direction of said light emitting portions total length that is greater than said height of said light indicator zone, and said light pipe is configured to receive and reflect light from substantially said total length to substantially fill said height of said light indicator zone.

4. An assembly according to claim 1 wherein said rear and forward reflection zones each define an angle of about 40–55 degrees with respect to said longitudinal axis and wherein said LED has a top planar surface, and said longitudinal axis of said light pipe is inclined with respect to said LED's top planar surface so that light entering said light entry surface is refracted to strike said first and second reflection zones and then be reflected in the direction of said longitudinal axis.

5. An assembly according to claim 1 for receiving and reflecting said forward and rearward light bundles from said LED to said light indicator zone, where the height between said LED's light entry surface and said top surface of said light pipe is less than the axial length of the light-emitting portions of said LED.

6. An assembly according to claim 1 wherein portions of said top and bottom surfaces of said light pipe are engaged and constrained by said housing.

7. An assembly according to claim 1 wherein said rear and forward light bundles comprise separate light emitting chips of separate colors, and said first and second reflection zones reflect said rear and forward light bundles to produce different colors of illumination in said light indicator zone.

8. An assembly according to claim 1 wherein said housing comprises a plurality of said modular jacks aligned side-by-side.

9. An assembly according to claim 1 wherein said second light reflection zone is generally parallel to said first light reflection zone.

10. An assembly according to claim 2 wherein said second light reflection zone is generally parallel to said first light reflection zone.

11. An assembly according to claim 1 wherein said light pipe's top surface defines therein a channel including axially spaced front and rear walls extending transversely between its opposite side surfaces and extending downward from said top surface toward said bottom surface, said front wall of said channel including thereon said second light reflection zone.

12. An assembly according to claim 11 wherein said first channel is situated in said light pipe such that some light emitted from said LED and received by said first reflection zone is reflected to said rear wall of said first channel where it is refracted and then exits said front wall of said first channel where it is again refracted and then travels to and is reflected off said bottom wall of said light pipe to said window.

13. An assembly according to claim 11 wherein said channel's rear wall is axially spaced from its front wall and defines a plane that is inclined rearwardly forming an acute angle with respect to said longitudinal axis.

14. An assembly according to claim 13 wherein said light pipe further defines a first separation plane intermediate said top and bottom surfaces, and wherein said second reflection zone extends down to said first separation plane and said first reflection zone extends up to said first separation plane.

15. An assembly according to claim 14 wherein said LED emits between said rear and front light emitting portions a third light ray bundle, and where said light pipe's bottom surface defines therein a second channel having rear and front walls extending transversely between its opposite side surfaces and extending upward from said bottom surface, and wherein said rear wall of said second channel includes thereon a secondary light reflection zone and said front wall thereof comprises a light refraction surface, whereby said third light ray bundle is received and reflected by said secondary light reflection zone and refracted by said refraction surface and directed to said window.

16. An assembly according to claim 15 wherein said second channel is situated axially intermediate said first and second light reflection zones and axially intermediate said rear and front light bundles.

17. An assembly according to claim 15 wherein said light pipe further defines a second separation plane intermediate said first separation plane and said bottom surface of said light pipe, and said second channel's reflection surface extends upward to said second separation plane, and said first reflection zone extends downward to said second separation plane.

18. A modular jack mountable on a PC board to overlie a surface mounted LED mounted on said PC board, said LED having rear and forward light-emitting portions which emit rear and forward light ray bundles respectively, said jack comprising a housing having front, rear, top and opposite side walls and a bottom, and defining in said front wall a recess for receiving a plug with at least one electrical contact in said housing for electrical engagement with said plug when it is inserted into said recess and a window adjacent said recess, said jack further comprising a light pipe having a top, bottom, front, rear and side surfaces and having a light-entry zone in said bottom surface, a first light reflection zone in said rear surface, and light indicator zone in said front surface, and defining a longitudinal axis in the rear-to-front direction, said light pipe further comprising in its top surface a second light reflection zone situated forward of said first light reflection zone, said first and second light reflection zones positioned to receive said rear and forward light bundles respectively from said LED, and to reflect said light bundles forward to said light indicator zone which is visible through said window.

19. A modular jack according to claim 18 wherein said second light reflection zone is generally parallel to said first light reflection zone.

20. A modular jack according to claim 18 wherein said first light reflection zone defines a plane that is inclined forwardly and forms an acute angle with respect to said longitudinal axis.

21. A modular jack according to claim 18 wherein said light pipe's top surface defines therein a channel including axially spaced front and rear walls extending transversely between its opposite side surfaces and extending downward from said top surface toward said bottom surface, said front wall of said channel including therein said second light reflection zone.

22. A modular jack according to claim 21 wherein said second light reflection zone is generally parallel to said first light reflection zone.

23. A modular jack according to claim 19 wherein said channel's rear wall is axially spaced from its front wall and defines a plane that is inclined rearwardly forming an acute angle with respect to said longitudinal axis.

24. A modular jack according to claim 23 wherein said light pipe further defines a first separation plane intermediate said top and bottom surfaces, and wherein said second reflection zone extends down to said first separation plane and said first reflection zone extends up to said first separation plane.

25. A light pipe operable with an LED having rear and forward light-emitting portions which emit rear and forward light ray bundles respectively, said light pipe having a top, bottom, front, rear and side surfaces and having a light-entry zone in said bottom surface, a first light reflection zone in said rear surface, and light indicator zone in said front surface, and defining a longitudinal axis in the rear-to-front direction, said light pipe further comprising in its top surface a second light reflection zone situated forward of said first light reflection zone, and said first and second light reflection zones positioned to receive said rear and forward light bundles respectively and to reflect light bundles forward to said light indicator zone.

26. A light pipe according to claim 25 wherein said channel's rear wall is axially spaced from its front wall and defines a plane that is inclined rearwardly forming an acute angle with respect to said longitudinal axis.

* * * * *